US007753758B1

(12) United States Patent
Arrington

(10) Patent No.: US 7,753,758 B1
(45) Date of Patent: Jul. 13, 2010

(54) BRASSIERE SUPPORT SYSTEM

(76) Inventor: Juliet L. Arrington, 1806 Calgary Dr., Birmingham, AL (US) 35022

( * ) Notice: Subject to any disclaimer, the term of this patent is extended or adjusted under 35 U.S.C. 154(b) by 141 days.

(21) Appl. No.: 12/015,008

(22) Filed: Jan. 16, 2008

(51) Int. Cl.
*A41B 3/00* (2006.01)

(52) U.S. Cl. ..... 450/89; 2/327; 2/336

(58) Field of Classification Search ..... 2/326, 2/327, 336, 338, 300, 311, 312, 313, 314, 2/315, 316, 317–325, 328, 329, 330; 24/563, 24/341, 372, 12, 305 R, DIG. 4, 199, 312, 24/313, 310; 450/89
See application file for complete search history.

(56) References Cited

U.S. PATENT DOCUMENTS

| | | | | |
|---|---|---|---|---|
| 1,401,227 | A | 12/1921 | Wyeth | |
| D383,888 | S | 9/1997 | Smith | |
| 5,868,601 | A | 2/1999 | Kelemencky | |
| 5,921,845 | A | 7/1999 | Scholtz | |
| 5,935,044 | A * | 8/1999 | Brewster | 450/86 |
| 5,964,642 | A * | 10/1999 | Fildan | 450/86 |
| 6,056,625 | A * | 5/2000 | Fildan | 450/86 |
| 6,135,853 | A | 10/2000 | Hopson | |
| 6,163,937 | A | 12/2000 | McKinnis et al. | |
| 7,278,900 | B1 * | 10/2007 | Ostaseski | 450/86 |
| 2005/0054264 | A1 | 3/2005 | Ward et al. | |
| 2009/0126163 | A1 * | 5/2009 | Groner | 24/302 |

* cited by examiner

*Primary Examiner*—Gloria Hale

(57) ABSTRACT

A brassiere support system includes a brassiere including a back strap and a pair of shoulder straps. The shoulder straps are each attached to the back strap and extend upwardly from the back strap. The shoulder straps are spaced from each other. A connector is removably coupled to each of the shoulder straps to pull the shoulder straps toward each other. The connector is slidable toward or away from the back strap to effect a change in lifting properties of the shoulder straps.

2 Claims, 4 Drawing Sheets

BRASSIERE SUPPORT SYSTEM

BACKGROUND OF THE INVENTION

Field of the Invention

The present invention relates to brassiere adjusting devices and more particularly pertains to a new brassiere adjusting device for adjusting the lifting properties of the shoulder straps of a brassiere.

SUMMARY OF THE INVENTION

The present invention meets the objectives presented above by generally comprising a brassiere including a back strap and a pair of shoulder straps. The shoulder straps are each attached to the back strap and extend upwardly from the back strap. The shoulder straps are spaced from each other. A connector is removably coupled to each of the shoulder straps to pull the shoulder straps toward each other. The connector is slidable toward or away from the back strap to effect a change in lifting properties of the shoulder straps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
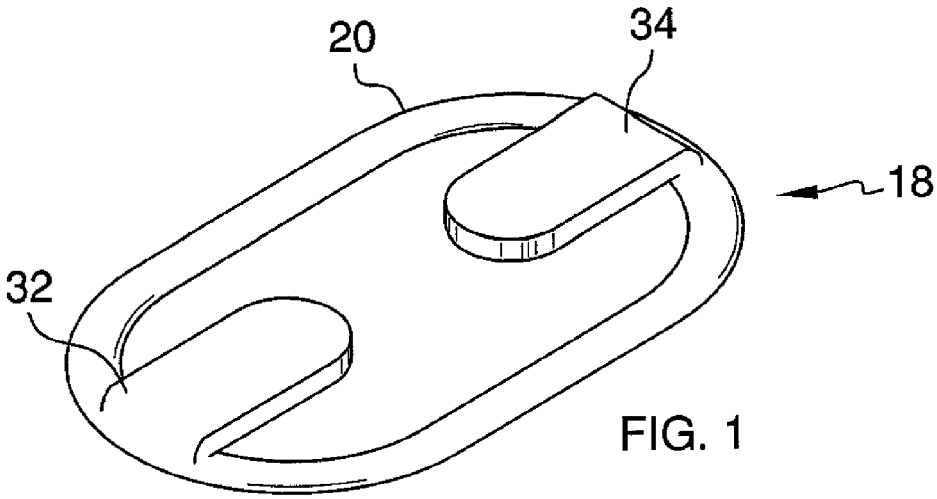
FIG. 1 is a perspective view of a brassiere support system coupler according to the present invention.
Figure 2:
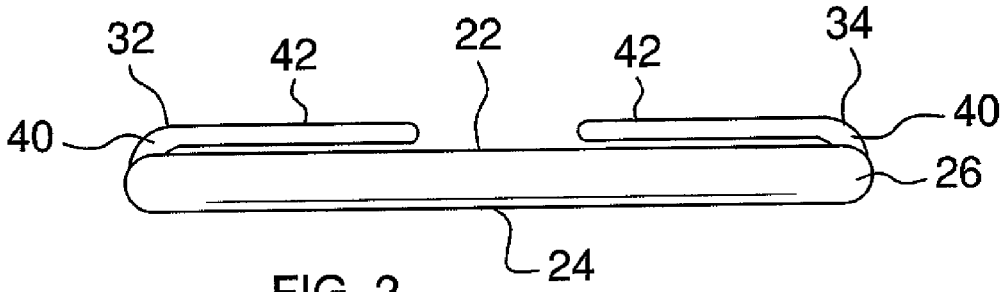
FIG. 2 is a side view of the coupler of the present invention.
Figure 3:
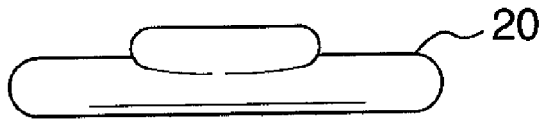
FIG. 3 is an end view of the coupler of the present invention.
Figure 4:
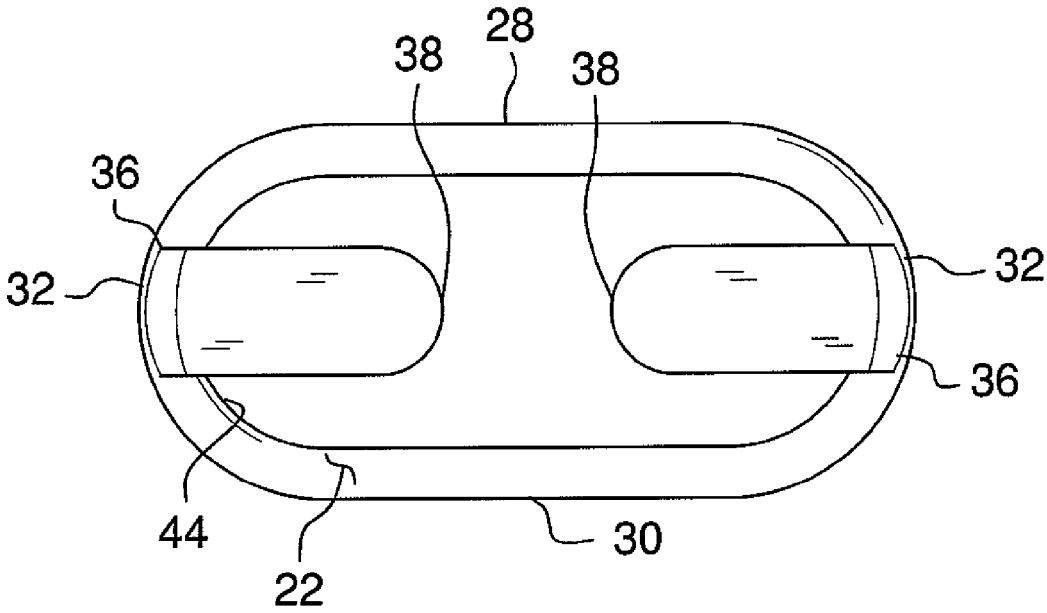
FIG. 4 is a front view of the coupler of the present invention.
Figure 5:
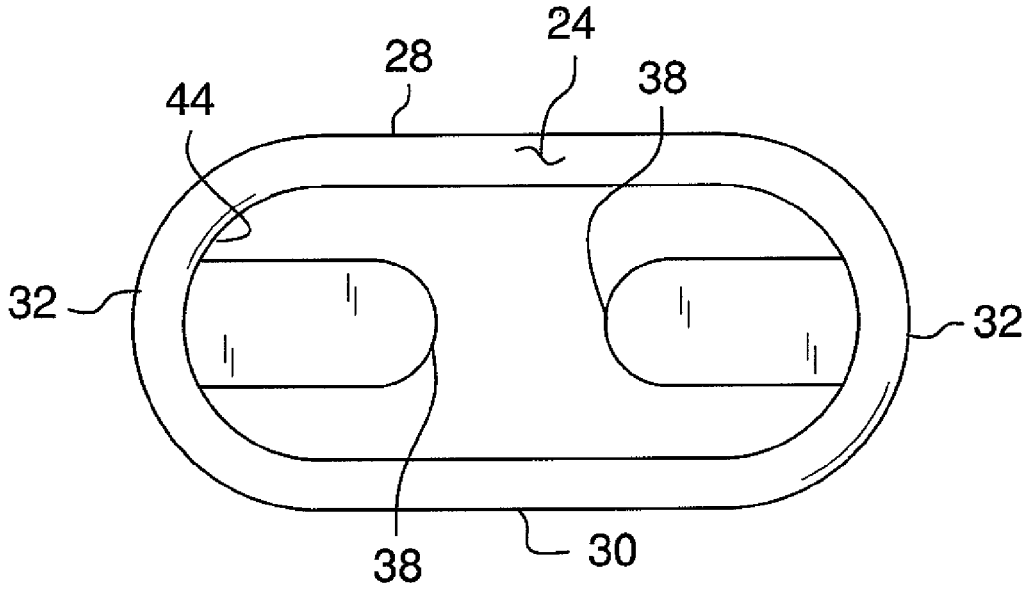
FIG. 5 is a rear view of the coupler of the present invention.
Figure 6:
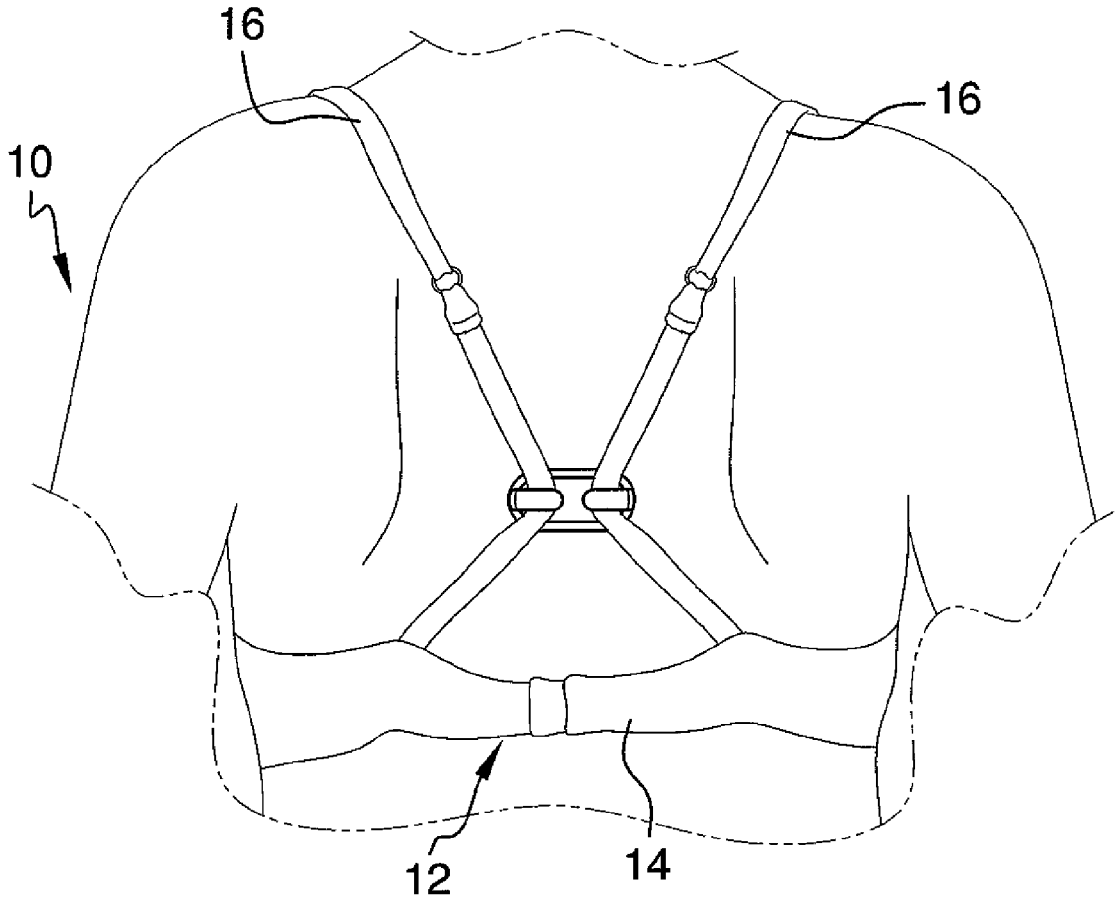
FIG. 6 is an in-use view of the present invention.

With reference now to the drawings, and in particular to FIGS. 1 through 8 thereof, a new brassiere adjusting device embodying the principles and concepts of the present invention and generally designated by the reference numeral 10 will be described.

As best illustrated in FIGS. 1 through 8, the brassiere support system 10 generally comprises a conventional brassiere 12 that includes a back strap 14 and a pair of shoulder straps 16. The shoulder straps 16 are each attached to the back strap 14 and extend upwardly from the back strap 14. The shoulder straps 16 are spaced from each other and are not coupled directly to each other.

A connector 18 is removably coupled to each of the shoulder straps 16 to pull the shoulder straps 16 toward each other. The connector 18 is slidable toward or away from the back strap 14 to effect a change in lifting properties of the shoulder straps 16. In this manner, the shoulder straps 16 will lift the cups of the brassiere 12 in different directions and at different heights depending on where the connector 18 is positioned relative to the back strap.

The connector 18 includes a plate 20 that has a first side 22, a second side 24 and a peripheral edge 26 extending between the first 22 and second 24 sides. The plate 20 is elongated and has an upper edge 28, a lower edge 30 and a pair of lateral edges 32. The lateral edges 32 are convexly arcuate while the upper 28 and lower 30 edges are linear and oriented parallel to each other. The plate 20 is comprised of a rigid material. The peripheral edge 26 may also be rounded for comfort.

The connector 18 also includes a pair of panels 32, 34 that are attached to the first side 22 of the connector 18. Each of the panels 32, 34 has a connected edge 36 and a free edge 38. The lateral edges 32 each have one of the connected edges 36 positioned adjacent thereto. The free edges 38 of the panels 32, 34 extend toward each other. Each of the panels 32, 34 includes a first portion 40 and a second portion 42. The first portions 40 of the panels 32, 34 include a respective one of the connected edges 36. The first portions 40 extend upwardly from the plate 20 and the second portions 42 lie in a plane oriented parallel to a plane of the plate 20. The first portions 40 extend away from the plate 20 a distance less than ⅓ inch. The plate 20 has a length measured between the lateral edges 32 between 1 inch and 3 inches and a height from the top edge 28 to the bottom edge 30 between ½ inch and 2 inches. The panels 32, 34 are spaced from each other a distance between ¼ inch and 1½ inches. The plate 20 has a centrally located aperture 44 therein. The second portions 42 of the panels 32, 34 extend over the aperture 44. The panels 32, 34 are comprised of a rigid material.

In use, one of the shoulder straps 16 is positioned between one of the panels 32 and the plate 20 and the other one of the shoulder straps 16 is positioned between the other one of the panels 34 and the plate 20. Because the straps 16 will be drawn tight, the straps 16 will remain between the plate 20 and corresponding ones of the panels 23, 34. The second side 24 of the plate 20 is positioned against a back of a person wearing the brassiere 12 and the plate 20 is moved upwardly or downwardly relative to the back strap 14 to change the positioning of the shoulder straps 16 as they extend over the shoulders over the wearer of the brassiere 12.

Figure 7:
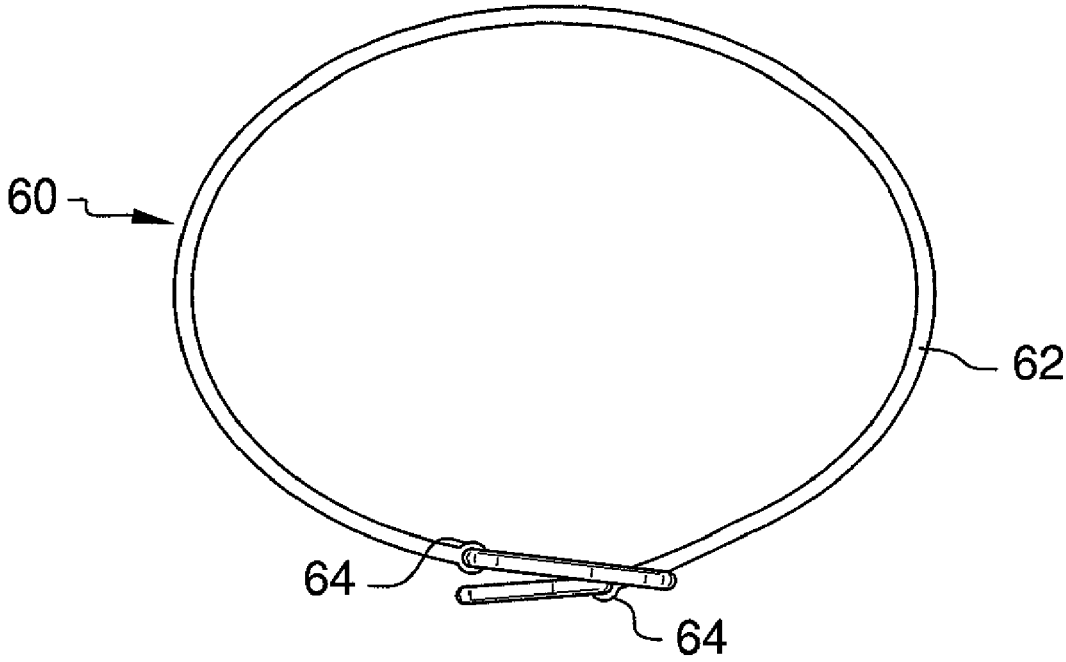
FIG. 7 is a top view of a second embodiment coupler of the present invention.
Figure 8:
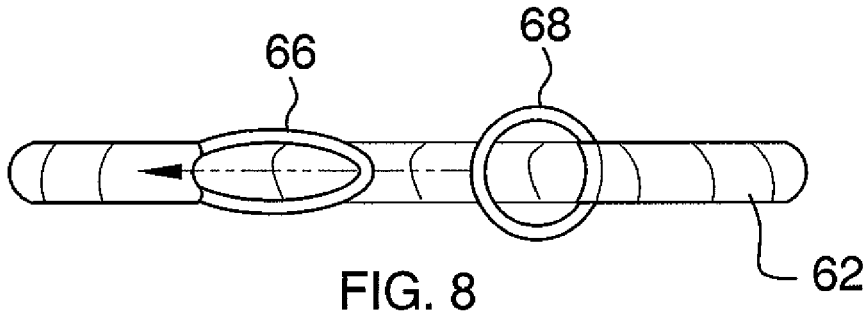
FIG. 8 is a front view of the second embodiment coupler of the present invention.

A second embodiment 60 of the system is found in FIGS. 7 and 8 and includes a tether 62 having a pair of ends 64. Loops 66, 68 are attached to the ends of the tether 62 and one of the loops 66 is elongated whereas the other loop 68 has a circular shape. The tether 62 is extended around the shoulder straps 16 and the circular loop 68 is extended into the elongated loop 62. When both loops 66, 68 are laid flat, the circular loop 68 is too large to be removed from the elongated loop 66, which retains the tether 62 around the shoulder straps 16. The second embodiment is used in a same way as the embodiment found in FIGS. 1-6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brassiere support system consisting of:

a brassiere including a back strap and a pair of shoulder straps, said shoulder straps each being attached to the back strap and extending upwardly from said back strap, said shoulder straps being spaced from each other;

a connector being removably coupled to each of said shoulder straps to pull said shoulder straps toward each other, said connector being slidable toward or away from said back strap to effect a change in lifting properties of said shoulder straps, said connector including;

a plate having a first side, a second side and a peripheral edge extending between said first and second sides, said plate being elongated and having an upper edge, a lower edge and a pair of lateral edges;

a pair of panels being attached to said first side of said connector, each of said panels having a connected edge and a free edge, each of said lateral edges having one of said connected edges positioned adjacent thereto, said free edges of said panels extending toward each other, each of said panels including a first portion and a second portion, said first portion of said panels including a respective one of said connected edges, said first portions extending upwardly from said plate and said second portions lying in a plane oriented parallel to a plane of said plate; and wherein one of said shoulder straps is positioned between one of said panels and said plate and the other one of said shoulder straps is positioned between the other one of said panels and said plate, said second side of said plate being positioned against a back of a erson wearing said brassiere.

2. A brassiere support system consisting of:

a brassiere including a back strap and a pair of shoulder straps, said shoulder straps each being attached to the back strap and extending upwardly from said back strap, said shoulder straps being spaced from each other;

a connector being removably coupled to each of said shoulder straps to pull said shoulder straps toward each other, said connector being slidable toward or away from said back strap to effect a change in lifting properties of said shoulder straps, said connector including;

a plate having a first side, a second side and a peripheral edge extending between said first and second sides, said plate being elongated and having an upper edge, a lower edge and a pair of lateral edges, said lateral edges being convexly arcuate, said upper and lower edges being linear and being oriented parallel to each other, said plate being comprised of a rigid material;

a pair of panels being attached to said first side of said connector, each of said panels having a connected edge and a free edge, each of said lateral edges having one of said connected edges positioned adjacent thereto, said free edges of said panels extending toward each other, each of said panels including a first portion and a second portion, said first portion of said panels including a respective one of said connected edges, said first portions extending upwardly from said plate and said second portions lying in a plane oriented parallel to a plane of said plate, said first portions extending away from said plate a distance less than ⅓ inch, said plate having a length measured between said lateral edges between 1 inch and 3 inches and a height from said top edge to said bottom edge between ½ inch and 2 inches, said plate having a centrally located aperture therein, said second portions of said panels extending over said aperture, said panels each being comprised of a rigid material; and wherein one of said shoulder straps is positioned between one of said panels and said plate and the other one of said shoulder straps is positioned between the other one of said panels and said plate, said second side of said plate being positioned against a back of a person wearing said brassiere.

* * * * *